US006200948B1

(12) United States Patent
Traber et al.

(10) Patent No.: US 6,200,948 B1
(45) **Date of Patent: *Mar. 13, 2001**

(54) MULTIFUNCTIONAL TEXTILE AUXILIARY FORMULATIONS

(75) Inventors: Rainer Hans Traber, Reinach (CH); Albert Stehlin, Rosenau (FR); Vladimir Arnold, Basel (CH); Rolf Kuratli, Basel (CH); Werner Schreiber, Basel (CH)

(73) Assignee: Ciba Specialty Chemicals Corporation, Tarrytown, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/908,875

(22) Filed: Aug. 8, 1997

Related U.S. Application Data

(63) Continuation of application No. 08/513,495, filed on Aug. 10, 1995, now abandoned.

(30) Foreign Application Priority Data

Aug. 11, 1994 (CH) ..... 2486/94

(51) Int. Cl.[7] ..... C11D 1/83
(52) U.S. Cl. ..... 510/422
(58) Field of Search ..... 510/424, 475, 510/476, 422

(56) References Cited

U.S. PATENT DOCUMENTS 5,156,761 10/1992 Aaslyng et al. ..... 252/174.12
5,458,847 * 10/1995 Guth et al. ..... 252/8.9

FOREIGN PATENT DOCUMENTS

92/11346 * 7/1992 (WO) .

* cited by examiner

*Primary Examiner*—John Hardee
(74) *Attorney, Agent, or Firm*—Kevin T. Mansfield

(57) ABSTRACT

The invention discloses multifunctional textile auxiliary formulations comprising (a) 10 to 60% by weight of one or more than one nonionic surfactant of formula (1),
(b) 10 to 60% by weight of the reaction product of one or more than one nonionic surfactant of formula (2) and of an ethylenically unsaturated sulfonic or carboxylic acid or an anhydride thereof,
(c) 4 to 20% by weight of a hydrotropic agent,
(d) 0 to 20% by weight of a nonionic surfactant of formula (3),
(e) 0 to 8% by weight of a magnesium salt of an organic carboxylic acid,
(f) 0 to 30% by weight of a chelating agent or sequestrant,
(g) 0 to 10% by weight of a diol or polyol, and
(h) 0 to 60% of water, with the proviso that the textile auxiliary formulations must contain one of components (e) to (g).

The novel textile auxiliary formulations are distinguished by their low foaming properties, their storage-stability, their peroxide-stabilizing properties, their good emulsifiability and their good rewettability. In addition, the formulations are readily biogradable.

11 Claims, No Drawings

MULTIFUNCTIONAL TEXTILE AUXILIARY FORMULATIONS

This is a continuation of application Ser. No. 08/513,495 filed on Aug. 10, 1995, now abandoned.

The present invention relates to storage-stable, low-foaming, silicone-free aqueous textile auxiliary formulations, to their preparation and to the versatile use thereof as wetting agents, detergents, dispersants or as stabilisers in peroxide bleaching liquors.

The novel textile auxiliary formulations comprise (a) 10 to 60% by weight of a nonionic surfactant of formula $$R_1—O—(\text{Alkylene-O})_{m_1}—H, \tag{1}$$

(b) 10 to 60% by weight of the reaction product of one or more than one nonionic surfactant of formula $$R_2—O—(\text{Alkylene-O})_{n_1}—R_3 \tag{2}$$

and an ethylenically unsaturated sulfonic acid or carboxylic acid or the anhydride thereof, (c) 4 to 20% by weight of a hydrotropic agent, (d) 0 to 20% by weight of a nonionic surfactant of formula $$R_4—O—(\underset{Y_1}{CH}—\underset{Y_2}{CH}—O)_{p_1}(\underset{Y_3}{CH}—\underset{Y_4}{CH}—O)_{p_1}—R_5, \tag{3}$$

(e) 0 to 8% by weight of a magnesium salt of an organic carboxylic acid, (f) 0 to 30% by weight of a chelating agent or sequestrant, (g) 0 to 10% by weight of a diol or polyol, and (h) 0 to 60% of water, with the proviso that said textile auxiliary formulations must always comprise one of components (e) to (g), in which formulae (1), (2) and (3) above $R_1$ and $R_2$ are each independently of the other $C_8$–$C_{22}$alkyl or $C_8$–$C_{22}$alkenyl, $R_3$ is hydrogen, $C_1$–$C_4$alkyl, a cycloaliphatic radical comprising at least 6 carbon atoms or benzyl, $R_4$ is $C_9$–$C_{14}$alkyl, $R_5$ is $C_1$–$C_8$alkyl, a cycloaliphatic radical comprising at least 5 carbon atoms, lower alkylphenyl or styryl $Y_1$, $Y_2$, $Y_3$ and $Y_4$ are each independently of one another hydrogen, methyl or ethyl, with the proviso that one of $Y_1$, $Y_2$, $Y_3$ and $Y_4$ must always be hydrogen, "Alkylene" denotes an alkylene radical comprising 2 to 4 carbon atoms, $m_1$ is an integer from 1 to 40, $n_1$ is an integer from 1 to 60, $p_1$ is an integer from 4 to 10, and $p_2$ is an integer from 0 to 8.

Components (a) to (g) may each consist of individual compounds or, alternatively, of several individual compounds.

Owing to their extremely low foaming tendency and to the good inhibition of process foam, the addition of further antifoaming agents, especially silicone-containing compounds, to the novel textile auxiliary formulations can be dispensed with.

The substituents $R_1$ and $R_2$ in formulae (1) and (2) are each preferably the hydrocarbon radical of a saturated or an unsaturated aliphatic monoalcohol of 8 to 22 carbon atoms. The hydrocarbon radical may be straight-chain or branched. Preferably $R_1$ and $R_2$ are each an alkyl or alkenyl radical of 9 to 14 carbon atoms.

Aliphatic saturated monoalcohols may suitably be natural alcohols, typically including lauryl alcohol, myristyl alcohol, cetyl alcohol or stearyl alcohol, as well as synthetic alcohols such as 2-ethylhexanol, 1,1,3,3-tetramethylbutanol, octan-2-ol, isononyl alcohol, trimethylhexanol, trimethylnonyl alcohol, decanol, $C_9$–$C_{11}$oxoalcohol, tridecyl alcohol, isotridecanol or linear primary alcohols (Alfols) of 8 to 22 carbon atoms. Some typical representatives of these Alfols are Alfol (8-10), Alfol (9-11), Alfol (10-14), Alfol (12-13) or Alfol (16-18). ("Alfol" is a registered trademark).

Unsaturated aliphatic monoalcohols are typically dodecenyl alcohol, hexadecenyl alcohol or oleyl alcohol.

The alcohol radicals may be single or in the form of mixtures of two or more components, typically as mixtures of alkyl and/or alkenyl groups which are derived from soybean fatty acids, palm nut fatty acids or tallow oils.

(Alkylene-O) chains are preferably divalent radicals of formulae $-(CH_2—CH_2—O)-$, $$-(\overset{CH_3}{\overset{|}{CH}}—CH_2—O)- \quad \text{or} \quad -(CH_2—\overset{CH_3}{\overset{|}{CH}}—O)- .$$

$R_4$ is the straight-chain hydrocarbon radical of a satuated aliphatic monoalcohol of 8 to 14 carbon atoms, typically n-octyl, n-nonyl, n-decyl, n-undecyl, n-dodecyl, n-tridecyl or n-tetradecyl.

$R_5$ in formula (3) defined as $C_1$–$C_8$alkyl is methyl, ethyl, n-propyl, isopropyl, n-butyl, sec-butyl or tert-butyl. Preferably $R_5$ is n-butyl.

Illustrative examples of a cycloaliphatic radical are cycloheptyl, cyclooctyl or, preferably, cyclohexyl.

Illustrative examples of nonionic surfactants suitable as component (a) are the polyadducts of 2 to 60 mol, preferably of 4 to 10 mol, of an alkylene oxide, in particular ethylene oxide, individual ethylene oxide units of which may be replaced by substituted epoxides such as propylene oxide and/or 1,2-butylene oxide, with higher unsaturated or saturated fatty alcohols of 8 to 22 carbon atoms, or mixtures of these compounds.

The preferred nonionic surfactant of component (a) is one or more than one compound of formula $$R_6—O—(\underset{Y_5}{CH}CH_2O)_{m_2}—H, \tag{4}$$

wherein $R_6$ is $C_8$–$C_{13}$alkyl;

$Y_5$ is hydrogen or methyl; and $m_2$ is 3 to 15.

Suitable starting monomers for the preparation of the polymers of component (b) are ethylenically unsaturated monomeric sulfonic acids or carboxylic acids or anhydrides thereof. Monocarboxylic acids and also dicarboxylic acids and anhydrides thereof as well as sulfonic acids may suitably be used, each of which contains an ethylenically unsaturated aliphatic radical and preferably not more than 7 carbon atoms. Monocarboxylic acids of 3 to 5 carbon atoms are preferred, e.g. acrylic acid, methacrylic acid, α-haloacrylic acid, 2-hydroxyethylacrylic acid, α-cyanoacrylic acid, crotonic acid and vinylacetic acid. Ethylenically unsaturated dicarboxylic acids are preferably fumaric acid, maleic acid or itaconic acid, and also mesaconic acid, citraconic acid, glutaconic acid and methylmalonic acid. The preferred anhydride of these acids is maleic anhydride.

Suitable monomeric sulfonic acids used for the polymerisation are typically vinylsulfonic acid or 2-acrylamido-2-methylpropanesulfonic acid.

The catalyst used for the preparation of component (b) is preferably an initiator that forms free radials. Illustrative examples of suitable initiators for carrying out the radical polymerisation are symmetrical aliphatic azo compounds such as azobis(isobutyronitrile), azobis(2-methylvaleronitrile), 1,1'-azobis(1-cyclohexanitrile) and alkyl 2,2'-azobis(isobutyrate); symmetrical diacyl peroxides such as acetyl peroxide, propionyl peroxide or butyryl peroxide, benzoyl peroxide, bromine-, nitro-, methyl- or methoxy-substituted benzoyl peroxides as well as lauroyl peroxide; symmetrical peroxydicarbonates such as diethyl, diisopropyl, dicyclohexyl as well as dibenzyl peroxydicarbonate; tert-butylperoctoate, tert-butylperbenzoate or tert-butylphenyl peracetate as well as peroxydicarbamates such as tert-butyl-N-(phenylperoxy)carbamate or tert-butyl-N-(2,3-dichloro- or -4-chlorophenylperoxy)carbamate. Further suitable peroxides are: tert-butyl hydroperoxide, di-tert-butylperoxide, cumene hydroperoxide, dicumene peroxide and tert-butylperpivalate. A further suitable compound is potassium persulfate, which is preferably used for the preparation of component (b).

The catalyst will normally be used in a amount of 0.1 to 10% by weight, preferably of 0.5 to 2% by weight, based on the starting materials.

Component (b) is preferably in the form of a partially neutralised compound that has a pH of 3–6. The preparation of the polymer typically comprises reacting an ethylenically unsaturated sulfonic acid or carboxylic acid or an anhydride thereof in the presence of a nonionic surfactant or in the presence of a mixture of nonionic surfactants of formula (2).

The reaction product is subsequently partially neutralised to pH 3–6, preferably 4–5, with an inorganic and/or organic base. Suitable bases are typically 1–8% by weight inorganic and/or organic bases such as sodium hydroxide, magnesium hydroxide, ethanolamine, triethanolamine, N,N,N,N-tetrakis(2-hydroxypropyl)ethylenamine or 1-amino-1-deoxysorbitol or mixtures thereof. Water is added to make up 100% by weight.

The polymerisation is conveniently carried out in an inert atmosphere, e.g. in the presence of nitrogen.

Component (b) is preferably the reaction product of 45 to 5% by weight of acrylic acid or methacrylic acid and 5 to 45% by weight of one or more than one nonionic surfactant of formula

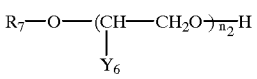

(5)

wherein $R_7$ is $C_8$–$C_{18}$alkyl;

$Y_6$ is hydrogen, methyl or ethyl; and $n_2$ is 1 to 40.

The hydrotropic agent of component (c) is suitably selected from:

aromatic alcohols of formula

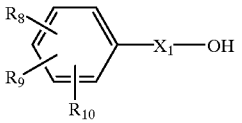

(6)

wherein $X_1$ is —$(CH_2)$1-6—, —CH═CH—$CH_2$— or —O—$(CH_2)$2-6—, and $R_8$, $R_9$ and $R_{10}$ are each independently of one another hydrogen, hydroxy, halogen or $C_1$–$C_6$alkoxy.

Illustrative examples of compounds of formula (6) are benzyl alcohol, 2,4-dichlorobenzyl alcohol, phenylethanol, phenoxyethanol, 1-phenoxy-2-propanol (phenoxyisopropanol) and cinnamyl alcohol;

sulfonates of terpenoids or mono- or binuclear aromatic compounds, e.g. the sulfonates of camphor, toluene, xylene, cumene and naphthol;

aliphatic saturated and unsaturated $C_1$–$C_{11}$-monocarboxylic acids such as acetic acid, propionic acid, hexanoic acid or undecylenic acid;

saturated or unsaturated $C_3$–$C_{12}$di- or polycarboxylic acids, e.g. malonic acid, succinic acid, glutaric acid, adipic acid, pimelic acid, suberic acid, azelaic acid and sebacic acid, undecanoic acid and dodecanedicarboxylic acid, fumaric acid, maleic acid, tartaric acid and malic acid, as well as citric acid and aconitic acid.

All the above-mentioned organic acids may also be in the form of their water-soluble salts, e.g. of the alkali metal salts, preferably sodium or potassium salts, or of the amine salts.

Other hydrotropic agents useful as component (c) in the practice of this invention are alkyl sulfates of formula $$R_{11}O—SO_3X_2, \quad (7)$$

wherein $R_{11}$ is an aliphatic saturated, branched or straight-chain radical of 4 to 24 carbon atoms, and $X_2$ is hydrogen, alkali metal or ammonium.

If the alkyl sulfate is in salt form, then it is conveniently the sodium, potassium or ammonium salt. The sodium salt is preferred.

The aliphatical saturated radical $R_{11}$ is derved from monoalcohols, suitably from natural or synthetic alcohols. Natural alcohols typically include lauryl, myristyl, cetyl, stearyl, arachidyl and behenyl alcohol. Preferred compounds are those in which $R_{11}$ is derived from branched aliphatic synthetic alcohols of 4 to 12, preferably 4 to 8, carbon atoms, e.g. isobutyl alcohol, sec-butanol, tert-butanol, isoamyl alcohol, 2-ethylbutanol, 2 -methylpentanol, 5-methylheptan-3-ol, 2-ethylhexanol, 1,1,3,3-tetramethylbutanol, octan-2-ol, isononyl alcohol, trimethyl hexanol, trimethylnonyl alcohol, n-decanol or $C_9$–$C_{11}$oxoalcohol.

The alkyl sulfates may already be in the form of their salts and can be used in the wetting agent of this invention singly or together with one another as a technical mixture.

An illustrative example of a hydrotropic agent of formula (7) is 2-ethylhexylsulfate.

These alkyl sulfates are prepared in per se known manner by reacting the appropriate alcohols with e.g. sulfuric acid, oleum, chlorosulfonic acid or sulfur trioxide.

Further preferred hydrotropic agents useful in the practice of this invention are amphoteric surfactants, typically including sodium lauriniminodipropionate, dihydroxyethyltallow fatty glycinate, disodium cocoamphodiacetate, disodium capryloamphodiacetate or, preferably, disodium dicarboxyethylcocopropylenediamine or tallow fatty amphopolycarboxyglycinate.

Important nonionic surfacants suitable as optional component (d) are compounds of formula

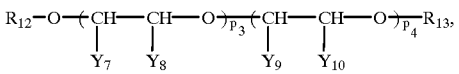

(8)

wherein $R_{12}$ is $C_9$–$C_{14}$alkyl;

$R_{13}$ is $C_1$–$C_4$alkyl;

$Y_7$, $Y_8$, $Y_9$ and $Y_{10}$ are each independently of one another hydrogen, methyl or ethyl, with the proviso that one of $Y_7$, $Y_8$, $Y_9$ and $Y_{10}$ is always hydrogen;

$p_3$ and $p_4$ are each independently of the other an integer from 4 to 8.

Illustrative examples of the end-capped nonionic surfactants of component (d) are polyadducts of $C_{10}$–$C_{12}$fatty alcohols and ethylene oxide or polyadducts of ethylene oxide and propylene oxide or the reaction product of 1 mol of a $C_{10}$fatty alcohol with 6 mol of ethylene oxide and 1 mol of butylene oxide, which polyadducts may each be end-capped with $C_1$–$C_4$alkyl, preferably methyl or butyl.

The nonionic surfactants of formulae (1) and (2) are prepared in per se known manner, typically by reacting the appropriate alkylene oxide polyadducts with thionyl chloride and subsequently reacting the resultant chloro compound with a saturated or unsaturated or unsaturated $C_8$–$C_{22}$monoalcohol.

The end-capped nonionic surfactants of formula (3) are prepared in per se known manner, typically by reacting ethylene oxide and/or propylene oxide and/or butylene oxide in the appropriate molar ratios with 1 mol of the alcohol $R_4$—OH, and subsequently reacting the resultant polyadduct with an alkyl halide $R_5$-Hal, preferably a $C_1$–$C_4$alkyl chloride.

The magnesium salts of carboxylic acids with complexing properties useful as component (e) are salts of gluconic acid, citric acid, malic acid, lactic acid, L-glutamic acid and L-aspartic acid.

It is preferred to use as component (e) a magnesium salt of gluconic acid and, most preferably, magnesium mono- or magnesium digluconate. The magnesium gluconate may be used in the novel formulation per se and preferably as solid. In a further embodiment of the invention, the gluconate may also be formed in situ from gluconic acid and magnesium oxide or, preferably, magnesium hydroxide. Furthermore, it is possible to use gluconic acid or the sodium salt thereof in combination with a water-soluble magnesium salt. A suitable water-soluble magnesium salt in this context is the acetate, most preferably the sulfate or its heptahydrate and, in particular, the chloride or its hexahydrate. The magnesium salt will usually be used as solid, in which case solid magnesium chloride hexahydrate is preferred.

Preferred sequestrants useful as component (f) in the novel formulation are compounds selected from ($f_1$) a mixture of monomers and oligomers of formulae (9a)

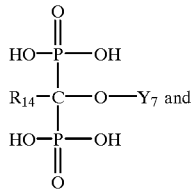

(9b)

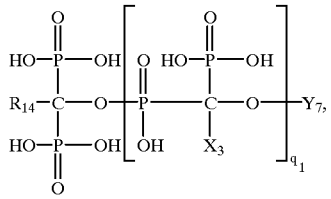

wherein $Y_7$ is hydrogen or —$COT_1$, $R_{14}$, $X_3$ and $T_1$ are each independently of one another $C_1$–$C_4$alkyl, and $q_1$ is 1 to 16

($f_2$) d-gluconic acid ($f_3$) citric acid, and ($f_4$) aminophosphonic acid.

The mixture of monomers and oligomers ($f_1$) is preferably a mixture of monomers and oligomers of formula (10a)

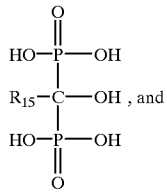

(10b)

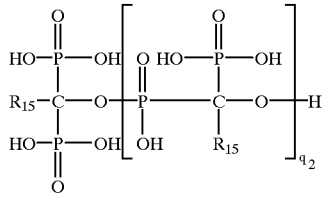

wherein $R_{15}$ is methyl or ethyl, and $q_2$ is 1 to 13.

The mixtures of the monomers and oligomers of the indicated kind are known per se and prepared by known methods. Thus, for example, the mixture of formulae (10*a*) and (10*b*) is preferably prepared by reacting phosphorus trichloride, acetic acid and, optionally, acetic anhydride in aqueous medium. The oligomeric constituents of component ($f_1$) are hydrolysed in the aqueous novel formulation, in the presence of an alkali metal hydroxide, at least partially to the corresponding monomers. Accordingly, monomers of one of formulae (9*a*) or (10*a*) are also preferably suitable as component ($f_1$) of the novel formulations.

Component ($f_1$) is preferably used in the novel formulation as a 35 to 90% by weight, more particularly a 40 to 85% by weight, most preferably a 40 to 60% by weight, aqueous solution.

Illustrative examples of component ($f_4$) are nitrilotrimethylenephosphonic acid, the sodium salt of ethylenediamine-tetramethylenephosphonic acid, the sodium salt of diethylenetriamine-pentamethylenephosphonic acid or N,N-bis (phosphonomethyl)glutamic acid.

Compounds suitable as component (f) act as sequestrants for alkaline earth metals and heavy metals in aqueous liquors which contain a per compound, e.g. hydrogen peroxide in the pretreatment, especially in processes for bleaching cellulosic fabrics. In particular, the presence of these components inhibits the decomposition of the per compound by free, i.e. non-complexed, heavy metals which may be present in the process water of the fibre material or in the added alkali.

Component (g) may suitably be a dihydric or polyhydric alcohol. Preferred dihydric alcohols are preferably those containing 2 to 6 carbon atoms in the alkyl moiety, typically including ethylene glycol, 1,2- or 1,3-propanediol, 1,3-, 1,4- or 2,3-butanediol, 1,5-pentanediol and 1,6-hexanediol or 2-methyl-2,4-pentanediol. It is preferred to use the last mentioned compound in the novel formulation.

Typical examples of polyhydric alcohols are glycerol, erythritol, the pentites such as arabite, adonite and xylite as well as the hexites, such as D-sorbitol, D-mannitol and dulcitol.

It is preferred to use textile auxiliary formulations which comprise (a) 10 to 60% by weight of one or more nonionic surfactants of formula

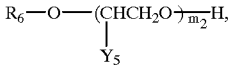

(4)

(b) 10 to 60% by weight of the reaction product of 5 to 45% by weight of one or more nonionic surfactants of formula

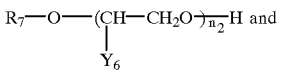

(5)

45 to 5% by weight of acrylic acid;

(c) 4 to 20% by weight of a hydrotropic agent selected from sodium cumene-4-sulfonate and dodecylimino-dipropionate disodium salt; and (d) 0 to 20% by weight of a nonionic surfactant of formula

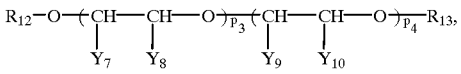

(8)

(e) 0 to 8% by weight of magnesium mono- or digluconate;

(f) 0 to 30% by weight of D-gluconic acid; and (g) 0 to 10% by weight of 2-methyl-2,4-pentanediol;

with the proviso that the textile auxiliary formulation must always comprise one of components (e) to (g), in which formulae above $R_6$ is $C_8$–$C_{13}$alkyl;

$R_7$ is $C_8$–$C_{18}$alkyl;

$R_{12}$ is $C_9$–$C_{14}$alkyl;

$R_{13}$ is $C_1$–$C_4$alkyl;

$Y_5$ is hydrogen or methyl;

$Y_6$ is hydrogen, methyl or ethyl;

$Y_7$, $Y_8$, $Y_9$, $Y_{10}$ are each independently of one another hydrogen, methyl or ethyl, with the proviso that one of $Y_7$, $Y_8$, $Y_9$ and $Y_{10}$ is always hydrogen;

$m_2$ is 4 to 15;

$n_2$ 1 to 40; and $p_3$ and $p_4$ are each independently of the other an integer from 4 to 8.

The novel textile auxiliary formulations can be prepared by charging components (a), (b), (c), and optional components (d), (e), (f) and (g) to water (component (h)), or by mixing the appropriate components, with stirring, and adding deionised water until a homogeneous solution is obtained. The procedure is a purely mechanical one which may be carried out at elevated temperature, conveniently at 30 to 40° C. A chemical reaction does not take place.

Another embodiment of the invention for the preparation of the novel textile auxiliary formulations comprises first preparing component (b) by reacting a monomeric ethylenically unsaturated sulfonic or carboxylic acid or an anhydride thereof, in the presence of one or more than one nonionic surfactant of formula (1) and/or (2) and of a catalyst, adjusting the pH to c. 4.5, and then adding the remaining components until a homogeneous solution is obtained.

The ready prepared textile auxiliary formulations have for example a pH of 2 to 5, preferably of 2.5 to 3.5. The pH is always relative to a 1% aqueous solution of the novel formulation. Any subsequent adjustment of the desired pH will typically be made with magnesium hydroxide, potassium hydroxide, mono-, di- or triethanolamine and, preferably, sodium hydroxide.

The novel formulations are storage-stable, monophase, low foaming and silicone-free textile auxiliaries having good chelating and sequestering properties with soil release activity. They have good emulsifying properties and are stable in alkaline liquor. They do not foam or form deposits in alkaline bleaching liquors. They additionally have good peroxide stabilising properties and effect a good wettability of the textile fabric. The formulations are also readily biodegradable. Owing to their liquid form they are easy to handle and are therefore particularly suitable for state-of-the-art metering devices. The multipurpose utility of the novel formulations makes them suitable for a variety of applications. They may typically be used as wetting agents, textile detergents, dispersants or as stabilisers in peroxide bleaching liquors. They are also preeminently suitable for use as all-purpose household detergents.

Accordingly, the invention relates also to a process for wetting, washing and/or bleaching fibre materials, which comprises treating said materials in aqueous medium and in the presence of a textile auxiliary formulation as claimed in claim 1.

The amounts in which the textile auxiliary formulations of this invention are added to the treatment liquors are from 0.1 to 60 g/l, 1 to 20 g/l, of treatment liquor. These liquors may contain further ingredients such as desizing agents, dyes, fluorescent whitening agents, synthetic resins and alkalies such as sodium hydroxide and hydrogen peroxide.

Suitable fibre materials are: cellulose, especially non-pretreated natural cellulose such as hemp, linen, jute, viscose staple, viscose, acetate rayon, natural cellulose fibres and, preferably, raw cotton, wool, polyamide, polyacrylonitrile or polyester fabrics and blends, for example polyacrylonitrile/cotton or polyester/cotton blends.

The fibre material can be in any form of presentation. For example, the cellulosic material may be in the form of loose stock, yarn, woven or knitted goods. The materials is thus usually always in the form of textile materials which are made from pure cellulosic textile fibres or from blends of cellulosic textile fibres with synthetic textile fibres. The fibre material can be treated continuously or batchwise in aqueous liquor.

The aqueous treatment liquors can be applied to the fibre materials in known manner, conveniently by impregnation on the pad to a pick-up of c. 70 to 120% by weight. The pad method is used especially in the pad-steam and pad-batch process.

Impregnation can be effected in the temperature range from 10 to 60° C., but preferably at room temperature. After impregnation and expression, the cellulosic material is subjected to an optional heat treatment the temperature range from 80 to 140° C. The heat treatment is preferably carried out by steaming at 95–140° C., most preferably at 100–106° C. Depending on the nature of the heat development and the temperature range, the heat treatment can take from 30 seconds to 60 minutes. In the pad-batch process, the impregnated goods are rolled up without being dried, packed in a plastic sheet, and stored at room temperature for 1 hour to 24 hours.

The treatment of the fibre materials can also be carried out in long liquors at a liquor to goods ratio of typically 1:3 to 1:100, preferably 1:4 to 1:25 and at 10 to 100° C., preferably at 60 to 98° C., for about ¼ hour to 3 hours, under normal conditions, i.e. under atmospheric pressure, in conventional apparatus such as a jigger, jet or winchbeck. If desired, the heat treatment can also be carried out in the temperature range up to 150° C., preferably from 10 to 140° C., under pressure in HT (high-temperature) apparatus.

If the process makes it necessary, the fibre materials are subsequently thoroughly rinsed with hot water of 90–98° C. and then with warm and, finally, cold water, if necessary neutralised, and then dried at elevated temperature.

In the following illustrative Examples, percentages are always by weight.

Preparation of the Individual Components

Example 1

Preparation of Component (b)

A flask with ground-glass stopper and fitted with a heating jacket is charged with 360.0 g of deionised water, 76.0 g of the reaction product of 1 mol of a $C_{13}$oxoalcohol and 9 mol of ethylene oxide, 48 g of the reaction product of 1 mol of a $C_{13}$oxoalcohol and 10 mol of ethylene oxide, at 20–30° C. and the contents of the flask are heated to 88–92° C. A milky turbid emulsion is obtained.

The simultaneous addition is then made at 90° C. of 124.0 g of acrylic acid and an initiator solution consisting of 0.75 g of potassium persulfate, dissolved in 60.0 g of deionised water. The acrylic acid is added over 180 minutes, and the initiator solution over 195 minutes. Afterwards the resultant polymer solution is stirred for about 15–30 minutes and then cooled to 25° C. During the cooling phase, 9.7 g of a 30% solution of sodium hydroxide are added below 70° C., with good stirring.

A clear, colourless product is obtained.

Example 2

Preparation of Component (b)

A flask with ground-glass stopper and fitted with a heating jacket is charged with 346.0 g of deionised water, 138.0 g of the reaction product of 1 mol of a $C_{13}$oxoalcohol and 9 mol of ethylene oxide, at 20–30° C. and the contents of the flask are heated to 88–92° C. A milky turbid emulsion is obtained.

The simultaneous addition is then made at 90° C. of 124.0 g of acrylic acid and an initiator solution consisting of 0.75 g of potassium persulfate, dissolved in 60.0 g of deionised water. The acrylic acid is added over 180 minutes, and the initiator solution over 195 minutes. Afterwards the resultant polymer solution is stirred for about 15–30 minutes.

Then 13.9 g of magnesium hydroxide are stirred in at 85–95° C. and the resultant homogeneous solution is cooled to 25° C. During the cooling phase, 321.6 g of deionised water are added below 70° C., with good stirring.

A clear, colourless product is obtained.

Preparation of the Novel Formulations

Example 3

The Following Components Are Mixed, With Stirring

24% of the reaction product of 1 mol of a $C_{13}$oxoalcohol and 6 mol of ethylene oxide, 22% of component (b) according to Example 1, 2.4% of disodium dicarboxyethylcocopropylenediamine, 10% of the reaction product of 1 mol of a $C_{12}$fatty alcohol and 6 mol of ethylene oxide/4 mol of propylene oxide 7.2% of 1-hydroxy-1,1-ethanediphosphonic acid, 3% of D-gluconic acid, 6% of 2-methyl-2,4-pentanediol, and 25.4% of water.

A low-viscous clear and homogeneous product is obtained.

The formulation is used as textile auxiliary for alkaline pulping processes, alkali washing and mercerising.

Example 4

The Following Components Are Mixed, With Stirring

32% of the reaction product of 1 mol of a $C_{13}$oxoalcohol and 7 mol of ethylene oxide, 8% of the reaction product of 1 mol of a $C_{13}$oxoalcohol and 6 mol of ethylene oxide, 28% of component (b) according to Example 1, 2.4% of disodium dicarboxyethylcocopropylenediamine, 4.8% of 1-hydroxy-1,1-ethanediphosphonic acid, 3% of D-gluconic acid, 6% of 2-methyl-2,4-pentanediol, and 14.6% of water.

A low-viscous clear and homogeneous product is obtained.

The formulation is used as textile auxiliary for alkaline pulping processes, alkali washing and mercerising.

Example 5

The Following Components Are Mixed, With Stirring

32% of the reaction product of 1 mol of a $C_{13}$oxoalcohol and 6 mol of ethylene oxide, 40% of component (b) according to Example 2, 1.8% of disodium dicarboxyethylcocopropylenediamine, 4.8% of 1-hydroxy-1,1-ethanediphosphonic acid, 3% of D-gluconic acid, 8% of 2-methyl-2,4-pentanediol, and 10.4% of water.

A low-viscous clear and homogeneous product is obtained.

The formulation is used as textile auxiliary for the cold-pad batch peroxide bleaching process.

Example 6

The Following Components Are Mixed, With Stirring

15% of the reaction product of 1 mol of a $C_{13}$oxoalcohol and 3 mol of ethylene oxide, 15% of the reaction product of 1 mol of a $C_{13}$oxoalcohol and 5 mol of ethylene oxide, 42% of component (b) according to Example 1, 4% of tallow fatty amphopolycarboxy glycinate, 12% of the reaction product of 1 mol of a $C_{10}$fatty alcohol and 6 mol of ethylene oxide/1 mol of butylene oxide, methyl-end-capped, 6% of 2-methyl-2,4-pentanediol, and 6% of water.

A low-viscous clear and homogeneous product is obtained.

The formulation is used as textile auxiliary for scouring and bleaching processes.

Example 7

The Following Components Are Mixed, With Stirring 3.5% of the reaction product of 1 mol of a $C_{13}$oxoalcohol and 5 mol of ethylene oxide, 9.5% of the reaction product of 1 mol of a $C_{13}$oxoalcohol and 6 mol of ethylene oxide, 2% of the reaction product of 1 mol of a $C_{13}$oxoalcohol and 9 mol of ethylene oxide, 12.6% of component (b) according to Example 1, 4% of the sodium salt of cumene-4-sulfonic acid, 2.5% of magnesium digluconate, and 65.9% of water.

A low-viscous clear and homogeneous product is obtained.

The formulation is used as textile auxiliary for the pad-steam peroxide bleaching process.

Example 8

The Following Components Are Mixed, With Stirring

15% of the reaction product of 1 mol of a $C_{13}$oxoalcohol and 6 mol of ethylene oxide, 20.7% of component (b) according to Example 2, 4% of the sodium salt of cumene-4-sulfonic acid, 2.4% of magnesium digluconate, and 57.9% of water.

A low-viscous clear and homogeneous product is obtained.

The formulation is used as textile auxiliary for the pad-steam peroxide bleaching process.

Example 9

The Following Components Are Mixed, With Stirring

30% of the reaction product of 1 mol of a $C_{11}$oxoalcohol and 4 mol of ethylene oxide, 42% of component (b) according to Example 1, but with a reaction product of 1 mol of a $C_{13}$oxoalcohol with 6 mol of ethylene oxide instead of the reaction product of 1 mol of a $C_{13}$oxoalcohol and 9 and 10 mol of ethylene oxide, 12% of the reaction product of 1 mol of a $C_{10}$fatty alcohol and 6 mol of ethylene oxide and 1 mol of butylene oxide, methyl-end-capped, 3% of dodecyliminodipropionate disodium salt, 6% of 2-methyl-2,4-pentanediol, and 7% of water.

A low-viscous clear formulation is obtained.

Example 10

The Following Components Are Mixed, With Stirring

30% of the reaction product of 1 mol of a $C_{11}$oxoalcohol and 4 mol of ethylene oxide, 42% of component (b) according to Example 1, but with a reaction product of 1 mol of a $C_{13}$oxoalcohol with 8 mol of ethylene oxide instead of the reaction product of 1 mol of a $C_{13}$oxoalcohol and 9 and 10 mol of ethylene oxide, 12% of the reaction product of 1 mol of a $C_{10}$fatty alcohol and 6 mol of ethylene oxide and 1 mol of butylene oxide, methyl-end-capped, groups, 3% of dodecyliminodipropionate disodium salt, 6% of 2-methyl-2,4-pentanediol, and 7% water.

A low-viscous clear formulation is obtained.

Example 11

The Following Components Are Mixed, With Stirring

30% of the reaction product of 1 mol of a $C_{11}$oxoalcohol and 4 mol of ethylene oxide, 42% of component (b) according to Example 1, but with the reaction product of 1 mol of a $C_{13}$oxoalcohol with 4 mol of ethylene oxide instead of the reaction product of 1 mol of a $C_{13}$oxoalcohol and 9 and 10 mol of ethylene oxide, 12% of the reaction product of 1 mol of a $C_{10}$ fatty alcohol and 6 mol of ethylene oxide and 1 mol of butylene oxide, methyl-end-capped, groups, 3% of dodecyliminodipropionate disodium salt, 6% of 2-methyl-2,4-pentanediol, and 7% of water.

A low-viscous clear formulation is obtained.

Example 12

The Following Components Are Mixed, With Stirring

30% of the reaction product of 1 mol of a $C_{11}$oxoalcohol and 4 mol ethylene oxide, 42% of component (b) according to Example 2, 12% of the reaction product of 1 mol of a $C_{10}$ fatty alcohol and 6 mol of ethylene oxide and 1 mol of butylene oxide, methyl-end-capped, groups, 3% dodecyliminodipropionate disodium salt, 6% of 2-methyl-2,4-pentanediol, and 7% of water.

A low-viscous opaque formulation is obtained.

Example 13

The Following Components Are Mixed, With Stirring

38% of the reaction product of 1 mol of a $C_{13}$oxoalcohol and 7 mol of ethylene oxide, 24% of component (b) according to Example 1, 6% of citric acid monohydrate, 4.8% of 1-hydroxy-1,1-ethanediphosphonic acid, 3% of D-gluconic acid, 6% of 2-methyl-2,4-pentanediol, and 18.2% of water.

A low-viscous clear formulation is obtained.

Application Examples

Example 14

Alkaline Hydrolysis by the Pad-Steam Process

Raw cotton fabric is impregnated on the pad at room temperature with a treatment liquor of the following composition:

2 g/l of the textile auxiliary formulation of Example 4 and 30 g/l of NaOH (100%).

The liquor pick-up is 100%. The goods are run for 10 minutes in a steamer with saturated steam of 102° C. and then washed off with hot water. Desized fabric of superior absorbency is obtained.

Example 15

Cold Pad-Bach Peroxide Bleach

Raw cotton fabric is impregnated on the pad at room temperature with a treatment liquor of the following composition:

12 g/l of the textile auxiliary formulation of Example 5, 30 g/l of NaOH (100%), and 50 m/l of hydrogen peroxide.

The liquor pick-up is 100%. The moist goods are batched up, wrapped in plastic sheeting and stored for 20 hours at room temperature while being slowly rotated. The goods are thereafter washed off with hot water, giving an absorbent fabric with a high degree of whiteness and only minor fibre damage.

Example 16

Pad-Steam Peroxide Bleach

Raw cotton fabric is sprayed with a treatment liquor of the following composition:

20 g/l of the textile auxiliary formulation of Example 8, 40 g/l of NaOH (100%) and 30 m/l of hydrogen peroxide (35%).

The fabric is sprayed in e.g. a Raco-Yet apparatus supplied by Rimisch-Kleinwefers. The pick-up is 140%. The moist goods are treated for 2 hours in a steamer with saturated steam of 102° C. and then washed off with hot water.

Absorbent fabric with a high degree of whiteness and only minor fibre damage is obtained.

What is claimed is:

1. A multifunctional textile auxiliary formulation, comprising (a) 10 to 60% by weight of a nonionic surfactant of formula $$R_1—O—(\text{Alkylene-O})_{n_1}—H, \quad (1)$$

(b) 10 to 60% by weight of the reaction product of one or more than one nonionic surfactant of formula $$R_2—O—(\text{Alkylene-O})_{n_1}—R_3 \quad (2)$$

and an ethylenically unsaturated sulfonic acid or carboxylic acid or the anhydride thereof, (c) 4 to 20% by weight of a hydrotropic agent selected from the group consisting of ($c_1$) aromatic alcohols of formula (6)

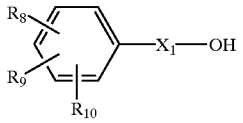

wherein $X_1$ is —$(CH_2)_{1-6}$—, —CH=CH—$CH_2$— or —O—$(CH_2)_{2-6}$—, and $R_8$, $R_9$ $R_{10}$ are each independently of one another hydrogen, hydroxy, halogen or $C_1$–$C_8$alkoxy;

($c_2$) alkyl sulfates of formula $$R_{11}O—SO_3X_2, \quad (7)$$

wherein $R_{11}$ is an aliphatic saturated, branched or straight-chain radical of 4 to 24 carbon atoms, and $X_2$ is hydrogen, alkali metal or ammonium; and ($c_3$) amphoteric surfactants selected from the group consisting of sodium lauriniminodipropionate, dihydroxyethyl-tallow fatty glycinate, disodium cocoamphodiacetate, disodium capryloamphodiacetate, disodium dicarboxyethylcocopropylenediamine or tallow fatty amphopolycarboxyglycinate;

(f) 7.8 to 30% by weight of a chelating agent or sequestrant;

(g) 6 to 10% by weight of a diol or polyol; and 0 to 60% of water, in which formulae (1) and (2) above $R_1$ and $R_2$ are each independently of the other $C_8$–$C_{22}$alkyl or $C_8$–$C_{22}$alkenyl, $R_3$ is hydrogen, $C_1$–$C_4$alkyl, a cycloaliphatic radical comprising at least 6 carbon atoms or benzyl, "Alkylene" denotes an alkylene radical comprising 2 to 4 carbon atoms, $m_1$ is an integer from 1 to 40 and $n_1$ is an integer from 1 to 60.

2. A textile auxiliary formulation according to claim 1, wherein component (a) is one or more than one nonionic surfactant of formula (4)

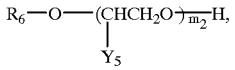

wherein $R_6$ is $C_8$–$C_{13}$alkyl;

$Y_5$ is hydrogen or methyl; and $m_2$ is 3 to 15.

3. A textile auxiliary formulation according to claim 1, wherein the ethylenically unsaturated carboxylic acid in component (b) is a monocarboxylic acid of 3 to 5 carbon atoms.

4. A textile auxiliary formulation according to claim 3, wherein the monocarboxylic acid used in component (a) is acrylic acid.

5. A textile auxiliary formulation according to claim 1, wherein component (f) consists of compounds selected from the group consisting of ($f_1$) a mixture of monomers and oligomers of formula (9)

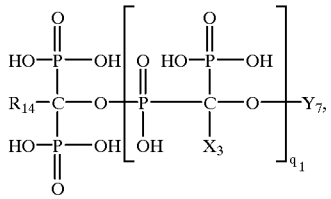

wherein $Y_7$ is hydrogen or —$COT_1$, $R_{14}$, $X_3$ and $T_1$ are each independently of one another $C_1$–$C_4$alkyl, and $q_1$ is 1 to 16

($f_2$) d-gluconic acid ($f_3$) citric acid, and ($f_4$) aminophosphonic acid.

6. A textile auxiliary formulation according to claim 10, wherein component (f) is D-gluconic acid.

7. A textile auxiliary formulation according to claim 1, wherein component (g) is 2-methyl-2,4-pentanediol.

8. A process for wetting, washing and/or bleaching fibre materials, which comprises wetting, washing and/or bleaching said materials in an aqueous medium which comprises a textile auxiliary formulation as defined in claim 1.

9. A process according to claim 8, wherein the textile auxiliary formulation is present in an amount of 0.1 to 60 g/l, per liter of aqueous medium.

10. A multifunctional textile auxiliary formulation, comprising (a) 10 to 60% by weight of a nonionic surfactant of formula $$R_1—O—(\text{Alkylene-O})_{m_1}—H, \quad (1)$$

(b) 10 to 60% by weight of the reaction product of one or more than one nonionic surfactant of formula $$R_2—O—(\text{Alkylene-O})_{n_1}—R_3 \quad (2)$$

and an ethylenically unsaturated sulfonic acid or carboxylic acid or the anhydride thereof, (c) 4 to 20% by weight of a hydrotropic agent selected from the group consisting of ($c_1$) aromatic alcohols of formula (6)

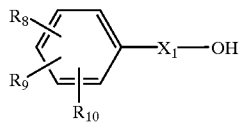

wherein $X_1$ is $—(CH_2)_{1-6}—$, $—CH=CH—CH_2—$ or $—O—(CH_2)_{2-6}—$, and $R_8$, $R_9$ and $R_{10}$ are each independently of one another hydrogen, hydroxy, halogen or $C_1$–$C_8$alkoxy;

($c_2$) alkyl sulfates of formula $$R_{11}O—SO_3X_2, \quad (7)$$

wherein $R_{11}$ is an aliphatic saturated, branched or straight-chain radical of 4 to 24 carbon atoms, and $X_2$ is hydrogen, alkali metal or ammonium; and ($c_3$) amphoteric surfactants selected from the group consisting of sodium lauriniminodipropionate, dihydroxyethyl-tallow fatty glycinate, disodium cocoamphodiacetate, disodium capryloamphodiacetate, disodium dicarboxyethylcocopropylenediamine or tallow fatty amphopolycarboxyglycinate;

(e) 2.4 to 8% by weight of a magnesium salt of an organic carboxylic acid, (f) 7.8 to 30% by weight of a chelating agent or sequestrant; and (h) 0 to 60% of water in which formulae (1) and (2) above $R_1$ and $R_2$ are each independently of the other $C_8$–$C_{22}$alkyl or $C_8$–$C_{22}$ alkenyl, $R_3$ is hydrogen, $C_1$–$C_4$alkyl, a cycloaliphatic radical comprising at least 6 carbon atoms or benzyl, "Alkylene" denotes an alkylene radical comprising 2 to 4 carbon atoms, $m_1$ is an integer from 1 to 40 and $n_1$ is an integer from 1 to 60.

11. A textile auxiliary formulation according to claim 10, wherein component ($c_3$) is disodium dicarboxyethylcocopropylenediamine or tallow fatty amphopolycarboxyglycinate.

* * * * *